US006640406B2

(12) United States Patent
Wilson

(10) Patent No.: US 6,640,406 B2
(45) Date of Patent: Nov. 4, 2003

(54) RAILROAD CLIP APPLICATOR SYSTEM

(76) Inventor: Timothy R. Wilson, 1805-2nd Ave. North, Moorhead, MN (US) 56560

( * ) Notice: Subject to any disclaimer, the term of this patent is extended or adjusted under 35 U.S.C. 154(b) by 0 days.

(21) Appl. No.: 10/076,755

(22) Filed: Feb. 13, 2002

(65) Prior Publication Data

US 2003/0150350 A1 Aug. 14, 2003

(51) Int. Cl.[7] ..... B23P 11/00

(52) U.S. Cl. ..... 29/243.56; 104/13; 104/7.1; 254/43

(58) Field of Search ..... 29/243.56; 104/2, 104/17.2, 7.1, 13; 238/351; 254/43, 44, 228, 233

(56) References Cited

U.S. PATENT DOCUMENTS 5,161,292 A * 11/1992 Kurtyak et al. ..... 29/243.56
5,165,346 A * 11/1992 Piekarski ..... 104/17.2
5,438,931 A * 8/1995 Becker et al. ..... 104/17.2
5,584,247 A * 12/1996 Almaraz et al. ..... 104/2
5,628,102 A * 5/1997 Johnson ..... 29/225
5,839,377 A * 11/1998 Brenny et al. ..... 104/17.2
5,884,381 A * 3/1999 Calusinski ..... 29/426.6
5,927,209 A * 7/1999 Cotsford ..... 104/2

* cited by examiner

*Primary Examiner*—S. Joseph Morano
*Assistant Examiner*—Frantz F. Jules
(74) *Attorney, Agent, or Firm*—Michael S. Neustel

(57) ABSTRACT

A railroad clip applicator system for efficiently securing a fastening clip to a receiver bracket of a crosstie. The railroad clip applicator system includes a housing, a handle structure attached to the housing, an actuator secured within the housing, an engaging structure attached to the actuator for engaging a fastening clip, and a pair of lower arms extending from the housing to engage a lower side of a rail. The engaging structure is comprised of a pair of guide pins slidably positioned within the housing, and an engaging member having a center member and a rear member for engaging the rear portion of the fastening clip. The actuator forces the engaging structure forwardly thereby causing the fastening clip to slide within the tapered slot of the receiver bracket until the fastening clip is fully secured upon the receiver bracket.

19 Claims, 10 Drawing Sheets

FIG 10c
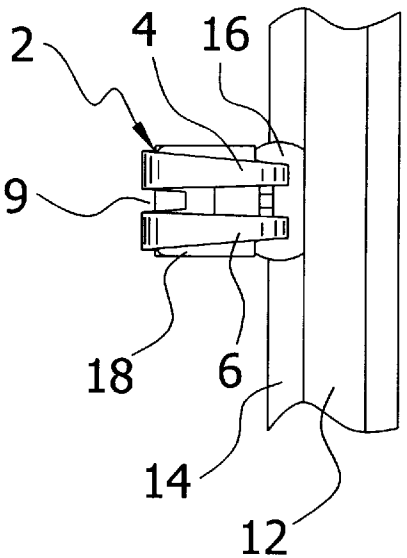
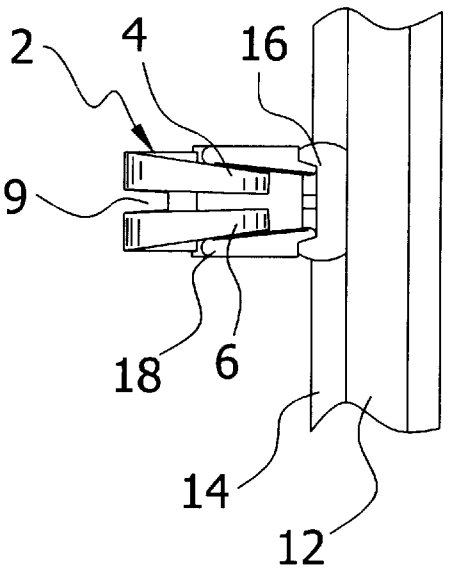
FIG 10b
FIG 10a
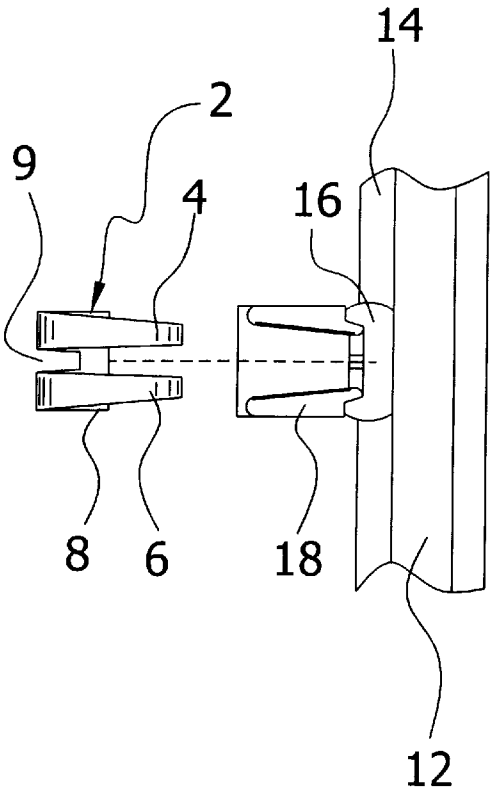

RAILROAD CLIP APPLICATOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to railroad clip applicators and more specifically it relates to a railroad clip applicator system for efficiently securing a fastening clip to a receiver bracket of a crosstie.

2. Description of the Prior Art

Crossties are an essential part of a railroad's structure. A crosstie is basically a transverse beam or rod serving as a support for the rails of a railroad. Crossties have conventionally been constructed of wood wherein a bracket structure is secured to each crosstie adjacent the rail with a spike driven into thereby securing the rail to the crosstie.

However, crossties are seeing heavier and more-frequent train wear than ever before. Wood, the perennial favorite, is seeing more competition from alternative materials, such as concrete, steel and plastic. Railroads are becoming more aware of alternative materials in their search to extend the life of their structures. Concrete crossties are the second most common form of crosstie after wooden crossties. Fastening clips are attached to a receiver bracket formed within or secured to the concrete adjacent to the rail thereby securing the rail in place upon the concrete crosstie. A common type of fastening clip is comprised of a C-shaped structure having a lower U-shaped portion curving upwardly and forwardly into a pair of parallel prongs with a rear slot between. To apply the fastening clip, the user must compress the sides of the prongs together and then insert into the receiver bracket and then release the prongs thereby locking the fastening clip within the receiver bracket and securing the rail to the receiver bracket.

However, it can be a very time consuming and tedious task to compress the sides of the fastening clips and then insert the fastening clips into the bracket structures of the concrete crossties. Hence, there is a need for an efficient fastening clip applicator system.

While these devices may be suitable for the particular purpose to which they address, they are not as suitable for efficiently securing a fastening clip to a receiver bracket of a crosstie. Conventional clip applicators are manual orientated and are time consuming to secure a fastening clip to a receiver bracket.

In these respects, the railroad clip applicator system according to the present invention substantially departs from the conventional concepts and designs of the prior art, and in so doing provides an apparatus primarily developed for the purpose of efficiently securing a fastening clip to a receiver bracket of a crosstie.

SUMMARY OF THE INVENTION

In view of the foregoing disadvantages inherent in the known types of railroad clip applicators now present in the prior art, the present invention provides a new railroad clip applicator system construction wherein the same can be utilized for efficiently securing a fastening clip to a receiver bracket of a crosstie.

The general purpose of the present invention, which will be described subsequently in greater detail, is to provide a new railroad clip applicator system that has many of the advantages of the railroad clip applicators mentioned heretofore and many novel features that result in a new railroad clip applicator system which is not anticipated, rendered obvious, suggested, or even implied by any of the prior art railroad clip applicators, either alone or in any combination thereof.

To attain this, the present invention generally comprises a housing, a handle structure attached to the housing, an actuator secured within the housing, an engaging structure attached to the actuator for engaging a fastening clip, and a pair of lower arms extending from the housing to engage a lower side of a rail. The engaging structure is comprised of a pair of guide pins slidably positioned within the housing, and an engaging member having a center member and a rear member for engaging the rear portion of the fastening clip. The actuator forces the engaging structure forwardly thereby causing the fastening clip to slide within the tapered slot of the receiver bracket until the fastening clip is fully secured upon the receiver bracket.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a railroad clip applicator system that will overcome the shortcomings of the prior art devices.

A second object is to provide a railroad clip applicator system for efficiently securing a fastening clip to a receiver bracket of a crosstie.

Another object is to provide a railroad clip applicator system that does not require significant manual labor.

An additional object is to provide a railroad clip applicator system that decreases the amount of time required to secure a fastening clip within a receiver bracket.

A further object is to provide a railroad clip applicator system that does not require more than one person to secure a fastening clip.

Another object is to provide a railroad clip applicator system that ensures proper securing of the fastening clip within a receiver bracket.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 10*a* is a top view of the fastening clip positioned away from the receiver bracket.

FIG. 10*b* is a top view of the fastening clip partially extended into the receiver bracket with the prongs compressed inwardly within the tapered slot of the receiver bracket.

FIG. 10*c* is a top view of the fastening clip fully extended into the receiver bracket with the prongs at their normal state and catchably retained upon the receiver bracket.

DESCRIPTION OF THE PREFERRED EMBODIMENT

Figure 1:
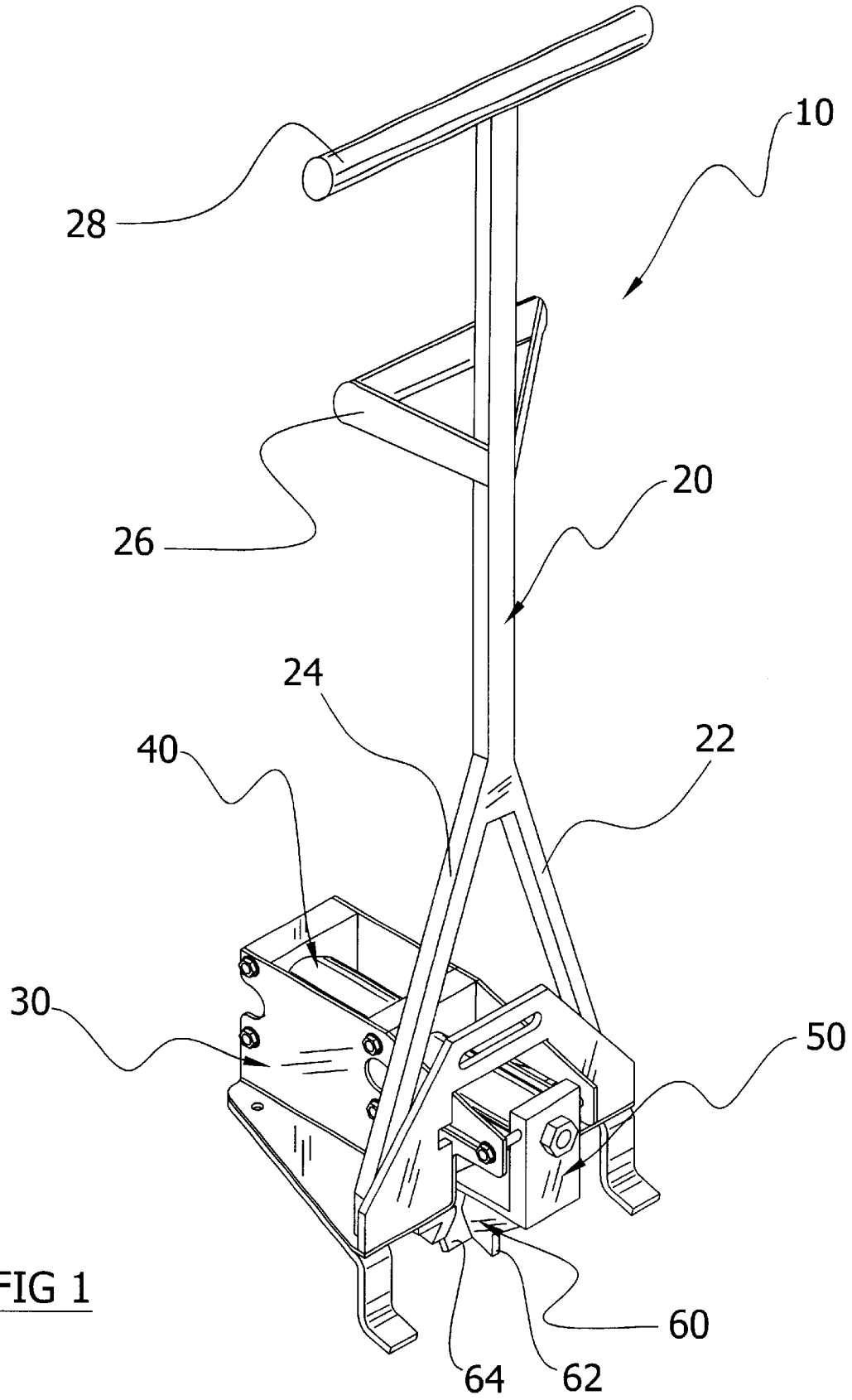
FIG. 1 is an upper perspective view of the present invention.

Turning now descriptively to the drawings, in which similar reference characters denote similar elements throughout the several views, FIGS. 1 through 10*c* illustrate a railroad clip applicator system 10, which comprises a housing 30, a handle structure 20 attached to the housing 30, an actuator 40 secured within the housing 30, an engaging structure 50 attached to the actuator 40 for engaging a fastening clip 2, and a pair of lower arms 38 extending from the housing 30 to engage a lower side of a rail 12. The engaging structure 50 is comprised of a pair of guide pins 52 slidably positioned within the housing 30, and an engaging member 60 having a center member 62 and a rear member 64 for engaging the rear portion of the fastening clip 2. The actuator 40 forces the engaging structure 50 forwardly thereby causing the fastening clip 2 to slide within the tapered slot of the receiver bracket 18 until the fastening clip 2 is fully secured upon the receiver bracket 18.

Figure 2:
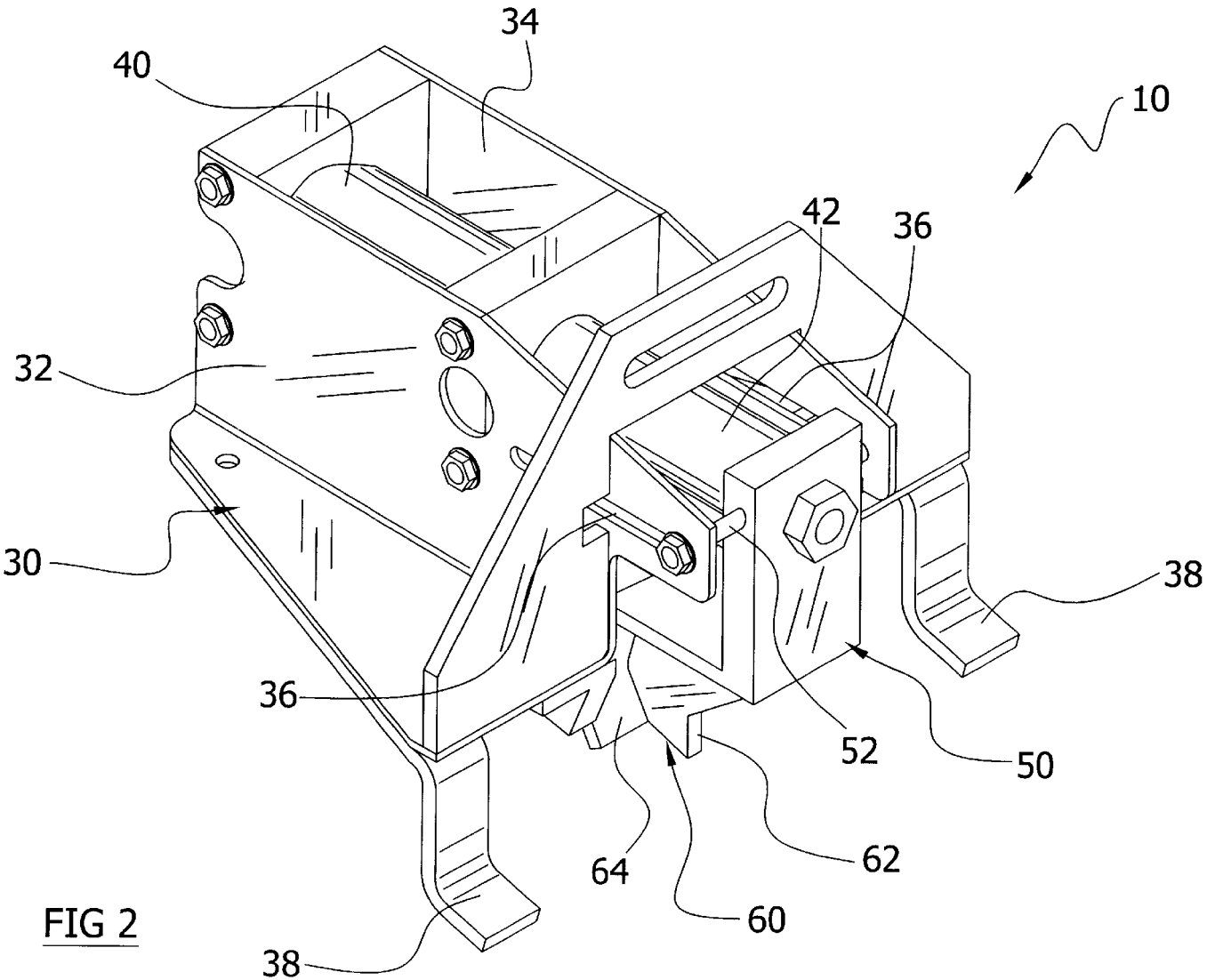
FIG. 2 is an upper perspective view of the present invention without the handle structure.

As shown in FIG. 2 of the drawings, the housing 30 is generally comprised of a first wall 32 attached to a second wall 34 by a plurality of structural elements. As can be appreciated, the housing 30 may be comprised of various other structures and designs not illustrated in the drawings.

Figure 4:
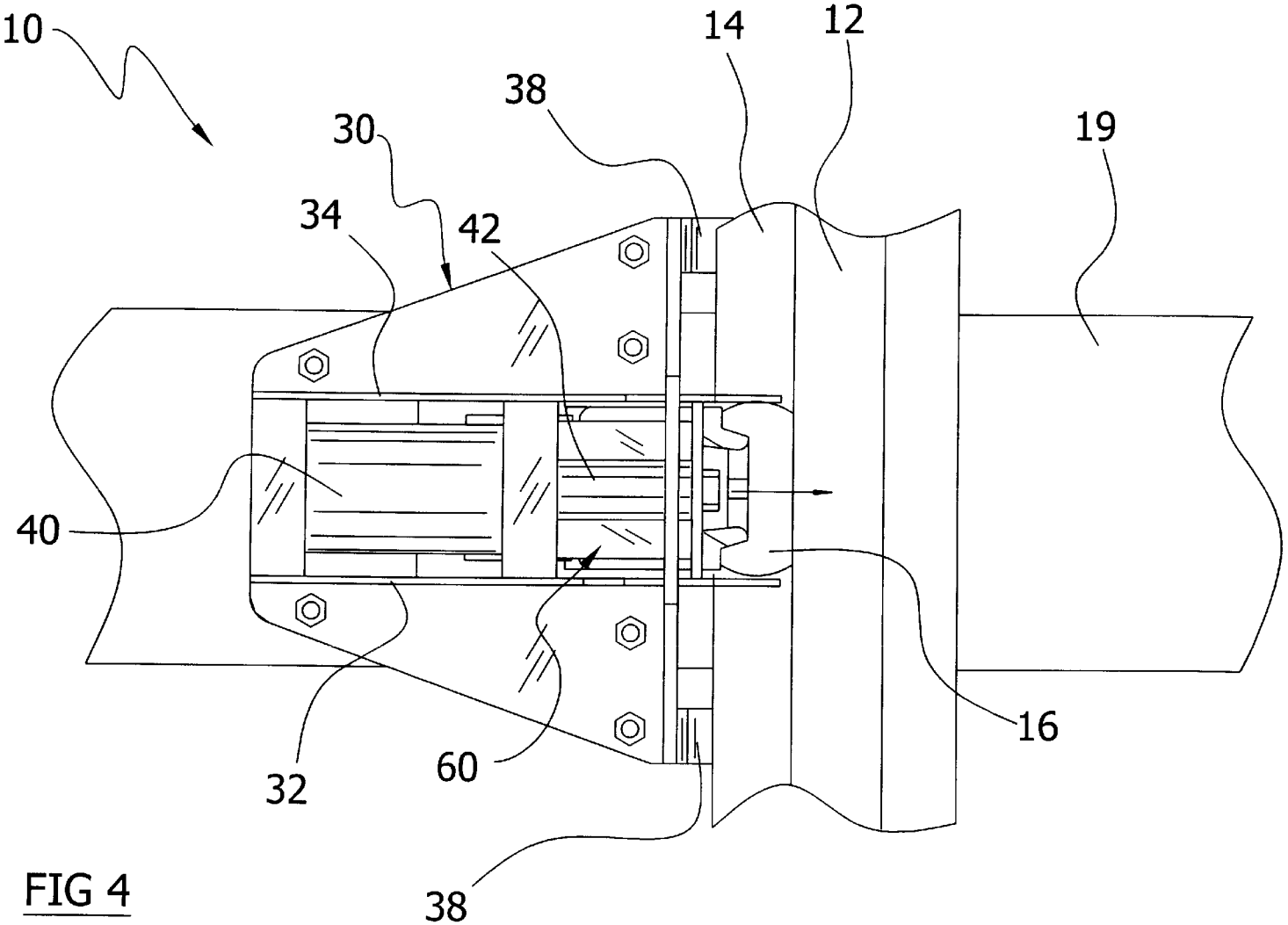
FIG. 4 is a top view of the present invention beginning to apply a fastening clip to the receiver bracket.
Figure 5:
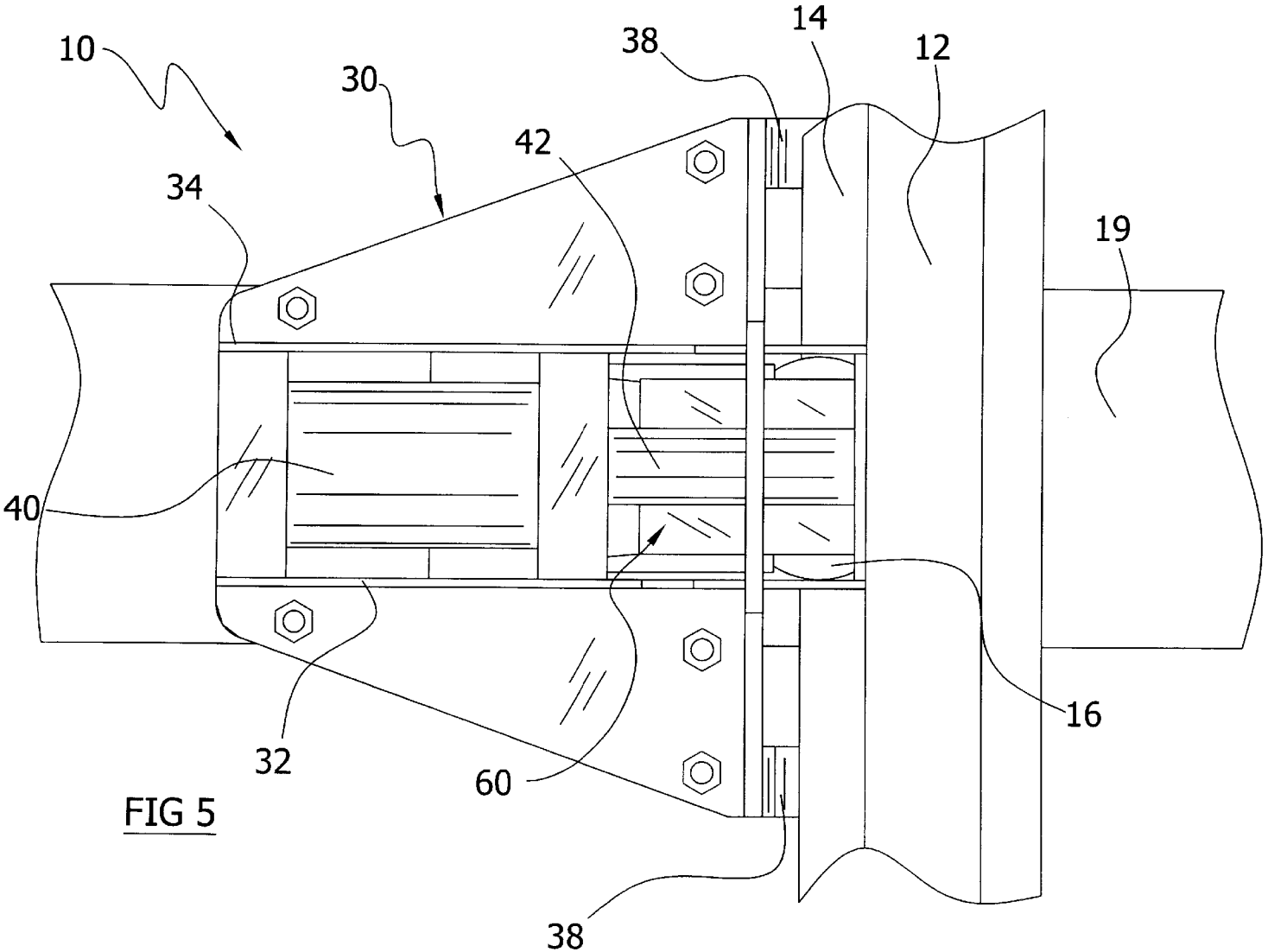
FIG. 5 is a top view of the present invention with the actuator fully extending the engaging structure.
Figure 6:
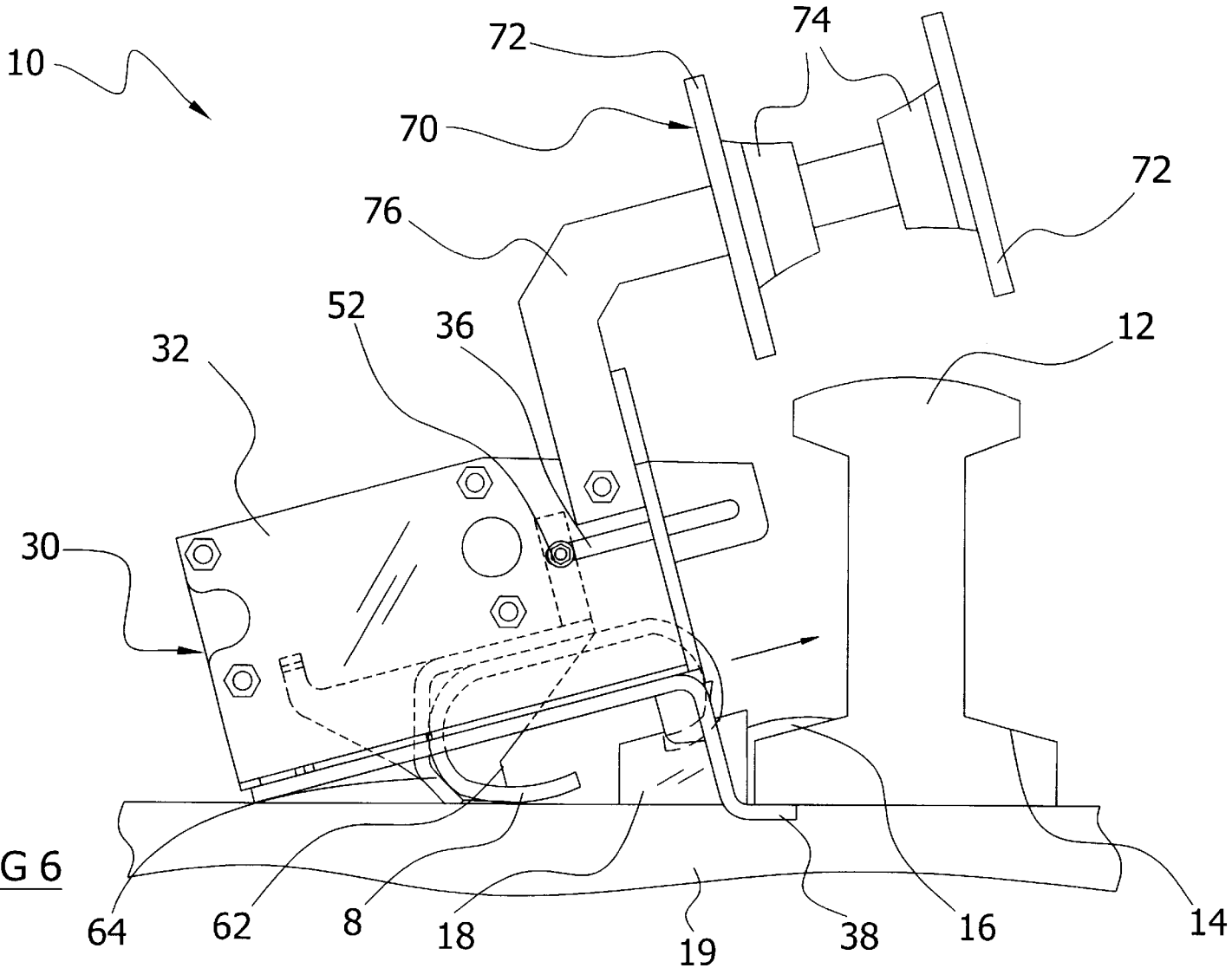
FIG. 6 is a side view of FIG. 5 in an alternative embodiment illustrating the usage of a support structure to allow for easy transporting of the applicator system upon the rail.
Figure 7:
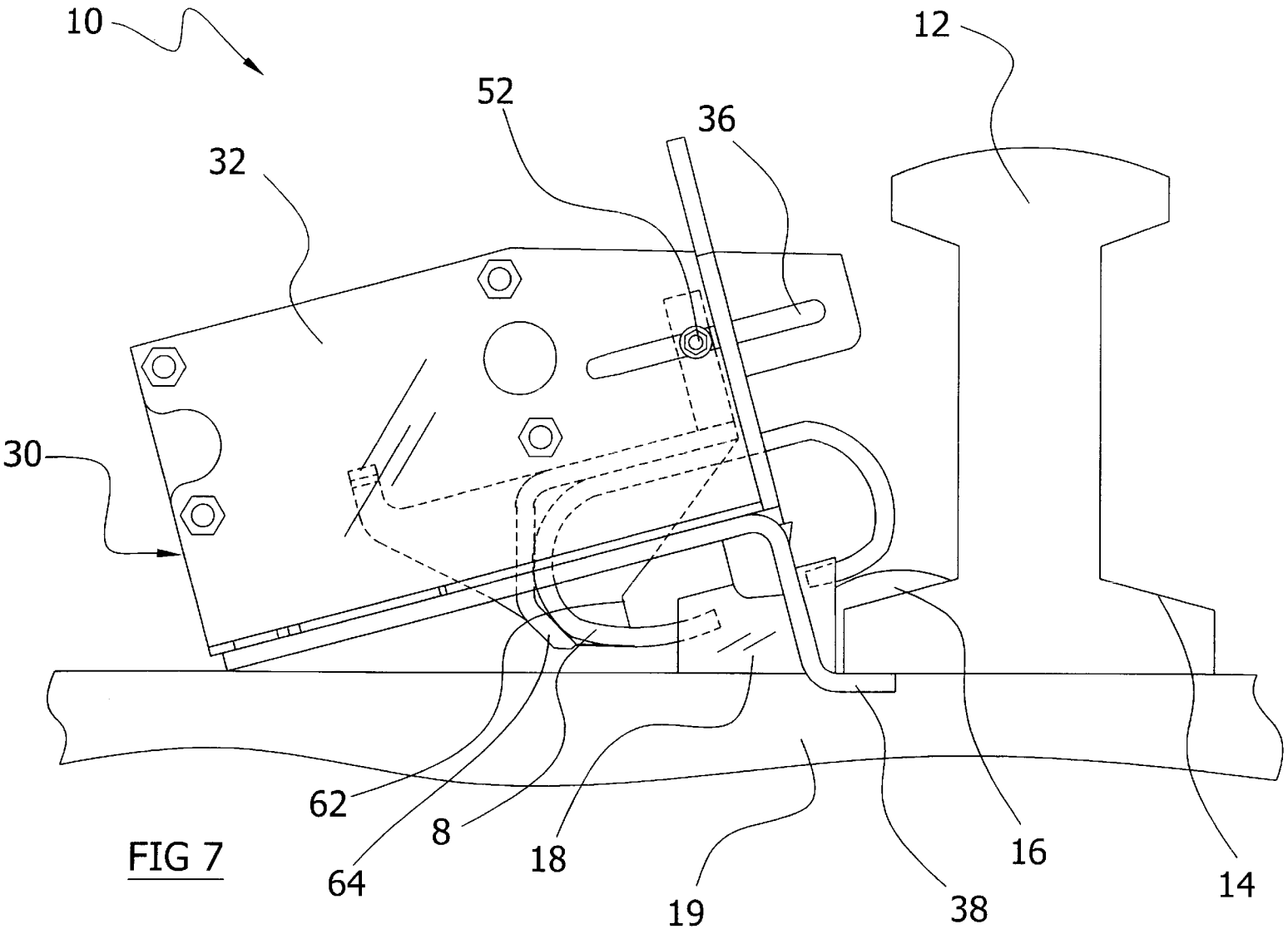
FIG. 7 is a side view illustrating the forcing of the fastening clip partially into the tapered slot of the receiver bracket.
Figure 8:
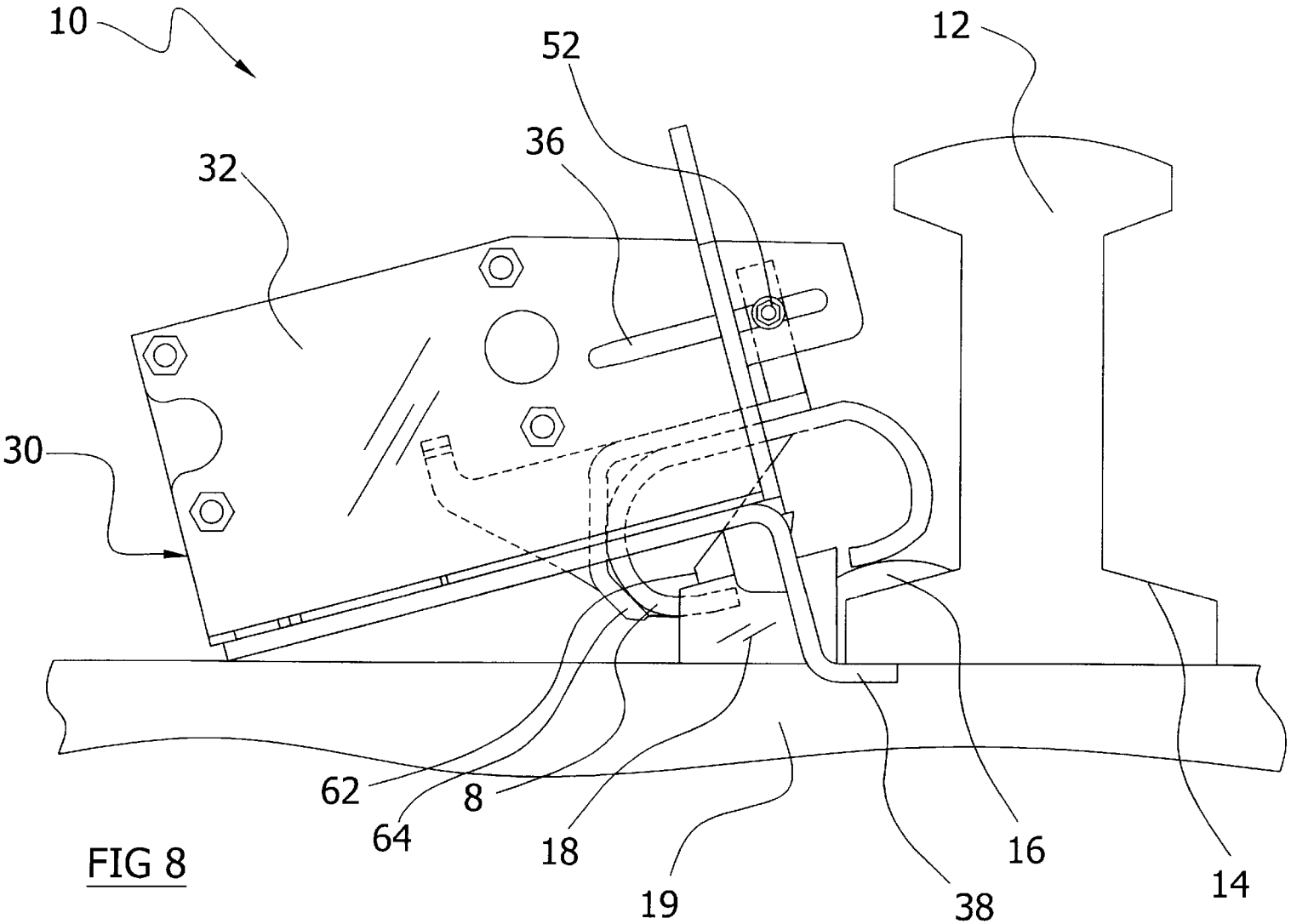
FIG. 8 is a side view illustrating the fastening clip fully secured upon the receiver bracket.
Figure 9:
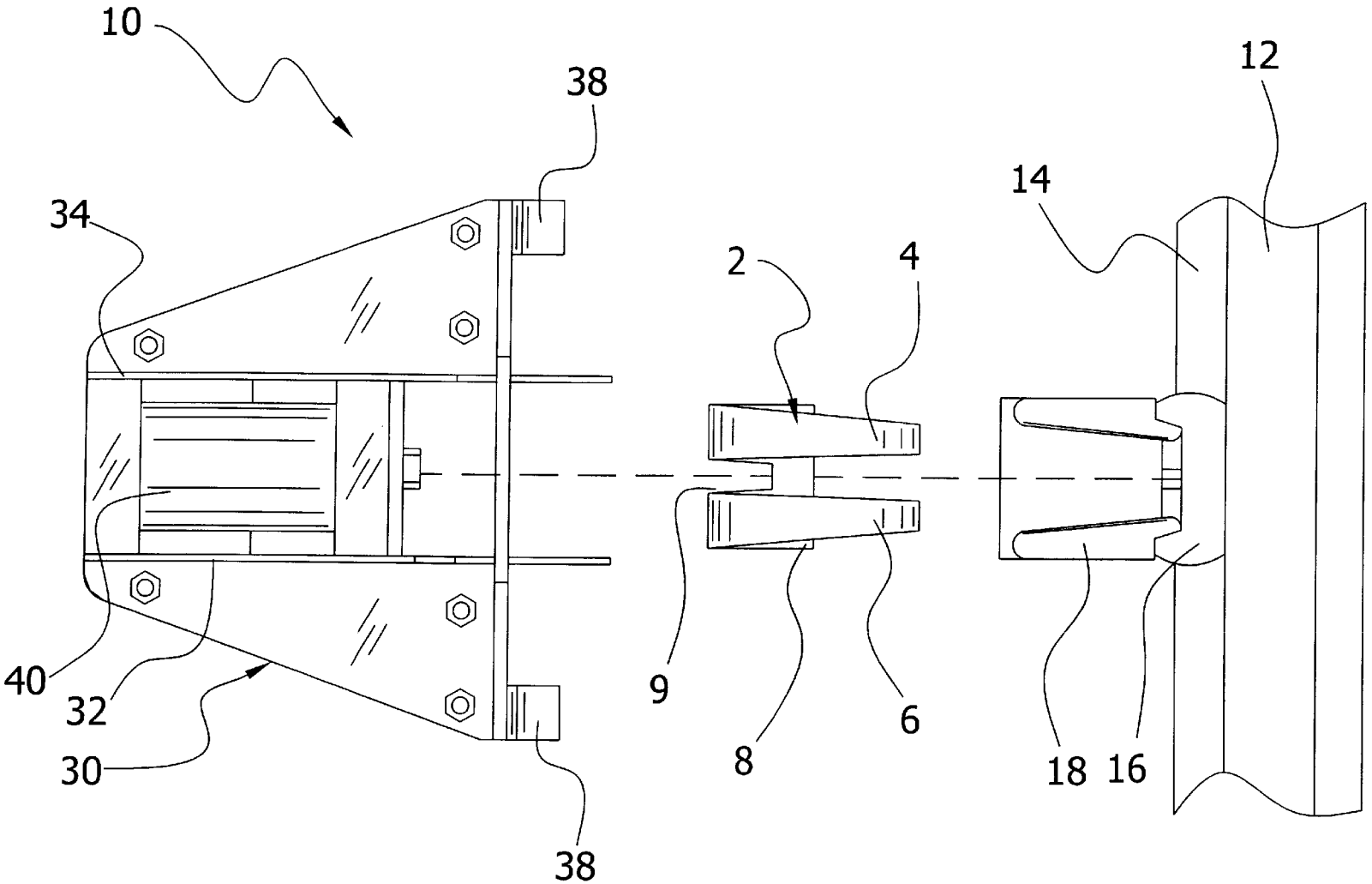
FIG. 9 is an exploded top view of the present invention with respect to a fastening clip, a receiver bracket and a rail.

As shown in FIG. 2 of the drawings, a pair of lower arms 38 extend from the housing 30 forwardly in a reverse L-shaped structure. The lower arms 38 catchably extend beneath the rail 12 during usage as best shown in FIGS. 6 through 8 of the drawings. The lower arms 38 are distally spaced sufficient to extend about the crosstie 19 as shown in FIGS. 4 and 5 of the drawings. It can be appreciated that more than two lower arms 38 may be utilized with the present invention.

At least one actuator 40 having an extendable shaft 42 is secured to a rear portion of the housing 30 as shown in FIGS. 2 through 5 of the drawings. The actuator 40 is preferably comprised of a hydraulic cylinder structure or other wellknown actuator system capable of exerting significant extension forces upon the shaft 42.

Figure 3:
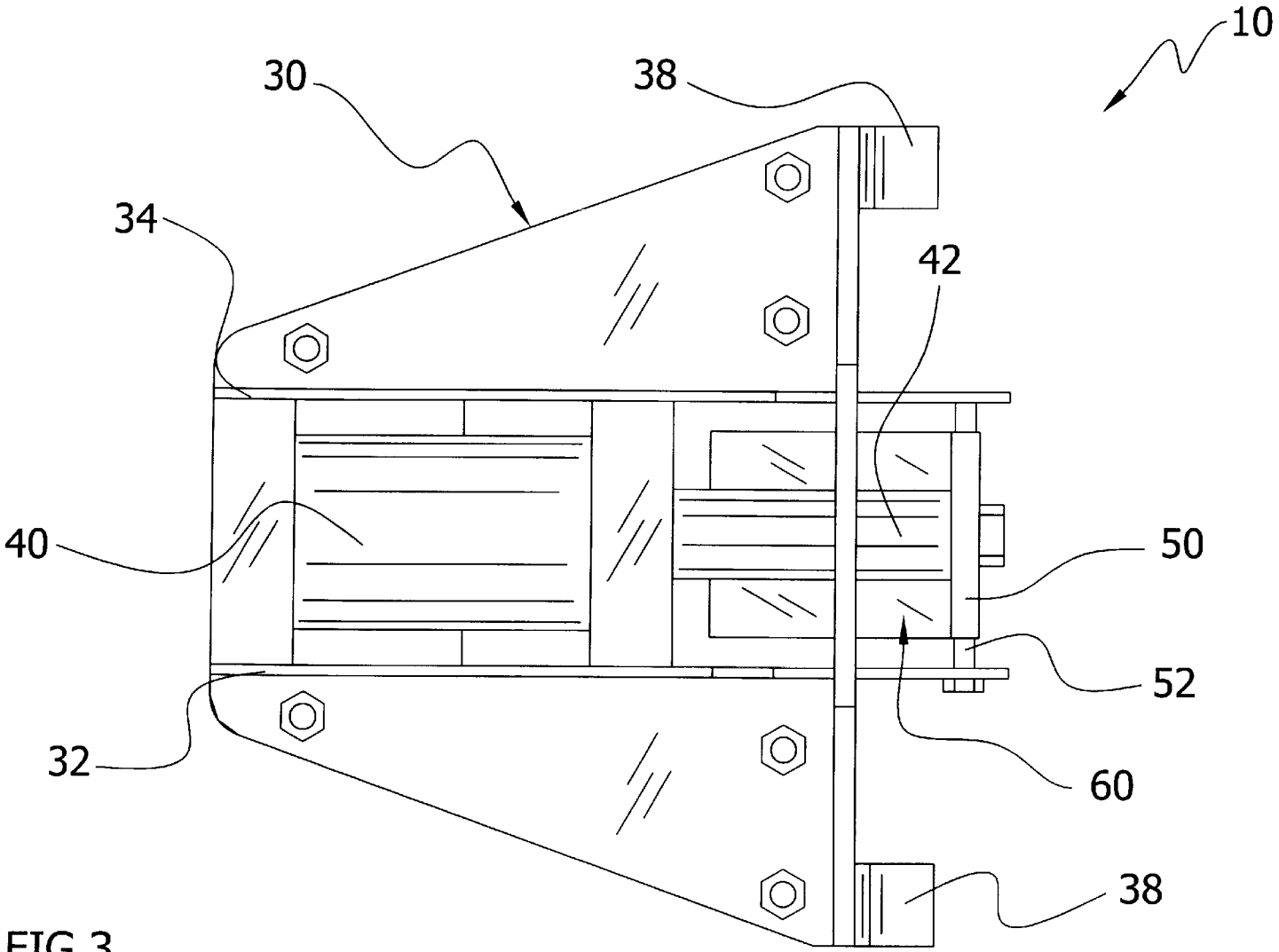
FIG. 3 is a top view of the present invention.

An engaging structure 50 is attached to the distal end of the shaft 42 as shown in FIGS. 1 through 3 of the drawings. The engaging structure 50 is formed for engaging a rear portion of a fastening clip 2 for forcing the fastening clip 2 into a tapered slot within a receiver bracket 18 secured within a crosstie 19. A pair of guide pins 52 traversely extend from the engaging structure 50 or the shaft 42 as shown in FIG. 3 of the drawings. The guide pins 52 are slidably positioned within elongate guide slots 36 within the first wall 32 and the second wall 34 of the housing 30 as shown in FIG. 2 of the drawings. As the actuator 40 is extended/contracted, the guide pins 52 maintain the engaging structure 50 at the desired level.

The engaging structure 50 includes an engaging member 60 that has a center member 62 and a rear member 64 traversely attached to one another. The center member 62 extends forwardly from the rear member 64 as shown in FIG. 2 of the drawings. The center member 62 is formed to fit within the rear slot 9 of the fastening clip 2 during installation thereof. The rear member 64 extends downwardly a finite distance and then angles forwardly to snugly form about the rear of the fastening clip 2 as best illustrated in FIGS. 6 through 8 of the drawings. The rear member 64 is a generally flat structure but may be comprised of various other structures.

As shown in FIG. 1 of the drawings, a handle structure 20 is preferably attached to the housing 30 for handling of the present invention. The handle structure 20 may be comprised of a first member 22 and a second member 24 attached to the front portion of the housing 30 as shown in FIG. 1 of the drawings. A middle handle 26 may extend from the middle portion of the handle structure 20 as further shown in FIG. 1 of the drawings. An upper handle 28 may extend from the upper end of the handle structure 20 as also shown in FIG. 1 of the drawings. Various other structures may be utilized to construct the handle structure 20 as can be appreciated.

In the alternative embodiment shown in FIG. 6 of the drawings, a transport structure 70 is attached to the housing 30 that allows for the sliding of the present invention along the rail 12 to each crosstie 19. The transport structure 70 is basically comprised of a roller structure rotatably attached to an arm member 76 as shown in FIG. 6. The roller structure rotatably surrounds and engages the upper portion of the rail 12 thereby allowing the user to tilt the invention forwardly during transportation and then manipulating along the length of the rail 12. The roller structure is comprised of a pair of inner rollers 74 having flanges 72 as shown in FIG. 6. However, various other roller structures may be utilized to construct the transport structure 70.

In use, the user positions the fastening clip 2 within the tapered slot of the receiver bracket 18. The present invention is then positioned so that the front edges of the lower arms 38 are engaged beneath the rail 12 as shown in FIG. 6 of the drawings. The user also must ensure that the engaging member 60 is properly positioned upon the fastening clip 2 with the center member 62 within the rear slot 9 and the rear member 64 adjacent the rear portion of the fastening clip 2. The user actuates the actuator 40 with a switch or other control mechanism thereby extending the shaft 42 forwardly which forces the engaging member 60 forwardly. As the engaging member 60 is forced forwardly, the prongs 4, 6 of the fastening clip 2 are forced into the tapered slot of the receiver bracket 18 thereby compressing the prongs 4, 6 toward one another as shown in FIGS. 7 and 10*b* of the drawings. The lower portion 8 of the fastening clip 2 is catchably received within a slot within the receiver bracket 18. The engaging member 60 continues to force the fastening clip 2 within the receiver bracket 18 until the lower edge of the front hooked portions of the prongs 4, 6 have passed the inner edge of the receiver bracket 18 thereby allowing the prongs 4, 6 to expand outwardly thereby catchably receiving the fastening clip 2 within the receiver bracket 18 as shown in FIGS. 8 and 10*c* of the drawings. The prongs 4, 6 thereby engage the lower portion 14 of the rail 12 with or without a pad member 16 positioned between thereof. The user then actuates the actuator 40 to contract the shaft 42 inwardly thereby removing the engaging member 60 from the fastening clip 2. The user then proceeds to the next fastening clip 2 to be secured.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

| Index of Elements for Railroad Clip Application System |
|---|
| 1. |
| 2. Fastening Clip |
| 3. |
| 4. First Prong |
| 5. |
| 6. Second Prong |
| 7. |
| 8. Lower Portion |
| 9. Rear Slot |
| 10. Railroad Clip Applicator System |
| 11. |
| 12. Rail |
| 13. |
| 14. Lower Portion |
| 15. |

-continued

| Index of Elements for Railroad Clip Application System |
|---|
| 16. Pad Member |
| 17. |
| 18. Receiver Bracket |
| 19. Crosstie |
| 20. Handle Structure |
| 21. |
| 22. First Member |
| 23. |
| 24. Second Member |
| 25. |
| 26. Middle Handle |
| 27. |
| 28. Upper Handle |
| 29. |
| 30. Housing |
| 31. |
| 32. First Wall |
| 33. |
| 34. Second Wall |
| 35. |
| 36. Guide Slots |
| 37. |
| 38. Lower Arms |
| 39. |
| 40. Actuator |
| 41. |
| 42. Shaft |
| 43. |
| 44. |
| 45. |
| 46. |
| 47. |
| 48. |
| 49. |
| 50. Engaging Structure |
| 51. |
| 52. Guide Pins |
| 53. |
| 54. |
| 55. |
| 56. |
| 57. |
| 58. |
| 59. |
| 60. Engaging Member |
| 61. |
| 62. Center Member |
| 63. |
| 64. Rear Member |
| 65. |
| 66. |
| 67. |
| 68. |
| 69. |
| 70. Transport Structure |
| 71. |
| 72. Flanges |
| 73. |
| 74. Inner Rollers |
| 75. |
| 76. Arm Member |
| 77. |
| 78. |
| 79. |

I claim:

1. A railroad clip applicator system for securing a fastening clip having a pair of prongs within a receiver bracket of a crosstie, comprising:

a frame;

a pair of lower arms extending from said frame for engaging a lower portion of a rail on opposing sides of said crosstie;

an actuator attached within said frame; and an engaging member attached to said actuator, wherein said engaging member is formed for engaging a rear portion of said fastening clip to insert into a tapered slot within said receiver bracket attached to said crosstie.

2. The railroad clip applicator system of claim 1, wherein said engaging member is comprised of a center member and a rear member traversely attached to said center member, wherein said center member is parallel to a longitudinal path of travel and positionable within a rear slot of said fastening clip.

3. The railroad clip applicator system of claim 2, wherein said rear member has a lower end angled forwardly.

4. The railroad clip applicator system of claim 1, including a pair of guide slots within said frame, and a pair of guide pins extending from said engaging member slidably positioned within said guide slots.

5. The railroad clip applicator system of claim 1, wherein said actuator is comprised of a hydraulic cylinder.

6. The railroad clip applicator system of claim 1, including a handle structure attached to said frame.

7. The railroad clip applicator system of claim 6, wherein said handle structure includes an upper handle attached to an upper end thereof and a middle handle attached below said upper handle.

8. The railroad clip applicator system of claim 1, including a transport structure comprised of:

an arm member attached to said frame and extending upwardly and above a rail; and a roller rotatably attached to said arm member for engaging an upper portion of a rail.

9. The railroad clip applicator system of claim 8, wherein said roller includes a pair of opposing flanges for surrounding said upper portion of said rail.

10. The railroad clip applicator system of claim 1, wherein said actuator extends at an upward angle with respect to said crosstie.

11. A railroad clip applicator system for securing a fastening clip having a pair of prongs within a receiver bracket of a crosstie, comprising:

a frame;

an actuator attached within said frame; and an engaging member attached to said actuator, wherein said engaging member is formed for engaging a rear portion of said fastening clip to insert into a tapered slot within said receiver bracket attached to said crosstie, wherein said engaging member is comprised of a center member and a rear member traversely attached to said center member, wherein said center member is parallel to a longitudinal path of travel and positionable within a rear slot of said fastening clip.

12. The railroad clip applicator system of claim 11, wherein said rear member has a lower end angled forwardly.

13. The railroad clip applicator system of claim 11, wherein said actuator is comprised of a hydraulic cylinder.

14. The railroad clip applicator system of claim 11, including a handle structure attached to said housing frame.

15. The railroad clip applicator system of claim 14, wherein said handle structure includes an upper handle attached to an upper end thereof and a middle handle attached below said upper handle.

16. The railroad clip applicator system of claim 11, including a transport structure comprised of:

an arm member attached to said frame and extending upwardly and above a rail; and a roller rotatably attached to said arm member for engaging an upper portion of a rail.

17. The railroad clip applicator system of claim 16, wherein said roller includes a pair of opposing flanges for surrounding said upper portion of said rail.

18. The railroad clip applicator system of claim 11, wherein said actuator extends at an upward angle with respect to said crosstie.

19. A railroad clip applicator system for securing a fastening clip having a pair of prongs within a receiver bracket of a crosstie, comprising:

a frame;

an actuator attached within said frame;

an engaging member attached to said actuator, wherein said engaging member is formed for engaging a rear portion of said fastening clip to insert into a tapered slot within said receiver bracket attached to said crosstie; and a pair of guide slots within said frame, and a pair of guide pins extending from said engaging member slidably positioned within said guide slots.

* * * * *